United States Patent [19]

Blumle

[11] Patent Number: 4,795,414

[45] Date of Patent: Jan. 3, 1989

[54] APPARATUS FOR PRODUCING GROOVES

[75] Inventor: Martin Blumle, Horhausen, Fed. Rep. of Germany

[73] Assignee: Winkler & Dunnebier Maschinenfabrik und Eisengiesserei GmbH & Co. KG, Neuwied, Fed. Rep. of Germany

[21] Appl. No.: 34,595

[22] Filed: Apr. 6, 1987

[30] Foreign Application Priority Data

Apr. 29, 1986 [DE] Fed. Rep. of Germany ..... 3614458

[51] Int. Cl.[4] ..... B31B 1/25

[52] U.S. Cl. ..... 493/403; 493/241

[58] Field of Search ..... 493/396, 400, 401, 402, 493/403, 240, 241

[56] References Cited

U.S. PATENT DOCUMENTS

| | | | |
|---|---|---|---|
| 2,048,069 | 7/1936 | Heywood | 493/241 |
| 2,098,970 | 11/1937 | Novick | 493/241 |
| 2,121,053 | 6/1938 | Robinson | 493/241 |
| 2,772,088 | 11/1956 | Nelson | 493/403 |
| 2,920,539 | 1/1960 | Doetsch | 493/241 |
| 4,141,544 | 2/1979 | Birkenmayer | 493/403 |
| 4,678,457 | 7/1987 | Slobodkin | 493/355 |

FOREIGN PATENT DOCUMENTS

| | | | |
|---|---|---|---|
| 361148 | 11/1931 | United Kingdom | 493/403 |
| 431025 | 6/1935 | United Kingdom | 493/241 |

*Primary Examiner*—Frederick R. Schmidt
*Assistant Examiner*—William E. Terrell
*Attorney, Agent, or Firm*—Collard, Roe & Galgano

[57] ABSTRACT

There is provided apparatus for grooving or producing partial cuts extending parallel to the direction of transport in paper webs, blanks, cardboard boxes and like workpieces, particularly in the manufacture of envelopes with at least one rotatably mounted grooving disc and an opposing tool in the shape of a roller. Prior to the grooving operation, the workpiece is bent about an axis transverse to the direction of transport.

3 Claims, 2 Drawing Sheets

APPARATUS FOR PRODUCING GROOVES

The present invention relates to apparatus for producing grooves or partial cuts extending parallel to the direction of transport in paper webs, blanks, cardboard boxes and like workpieces, and particularly in the manufacture of envelopes with at least one rotatably mounted grooving disc and an opposing tool in the shape of a roller.

Methods and apparatus of this type for producing grooves and partial cuts transverse to the direction of transport of the workpiece and in the longitudinal direction are known. The grooves or partial cuts serve e.g. in connection with envelope blanks as foldlines for the side flaps or the outer flap. The paper thickness of envelope blanks is commonly of the order of a tenth of a millimeter, while the depth of penetration of the annular disc can be of the order of up to five tenths of a millimeter. Furthermore, the blanks or workpieces which are to be provided with grooves or partial cuts are not only transported by the processing machine but also guided by it whereby different rollers hold the paper web, the form blank or the tool between themselves in a wide variety of manners. The common type of guiding has the consequence that it is e.g. relatively unproblematic to produce transverse grooves in a paper blank because the paper can yield in the transport direction. It is however different with longitudinal grooves in laterally guided paper webs or paper blanks. The guide rollers disposed on the left and right of the longitudinal grooves which are to be produced prevent the paper or the workpiece from being able to slip back during penetration of the grooving tool. This then leads to undesired and unchecked deformations of different types of the workpiece. Such deformations are, e.g. irreversible curvatures, and can be considerable, especially if the depth of penetration of the grooving tool is of the order which is a multiple of the paper thickness of a paper blank. If the different flaps of the paper blanks are folded to form an envelope and glued together, the curvatures caused by the partial cuts lead in general to the envelope not being inherently flat. This is associated in turn with problems in the further processing of the envelopes, e.g. in automatically operated insertion installations.

By virtue of each groove or each partial cut a change in length occurs in the paper web or blank being processed. It is the object of the present invention to provide measures whereby these changes in length with longitudinal grooves, that is to say, with grooves extending in the direction of transport or parallel thereto, do not lead to unchecked changes in length or deformations which then result in the finished product, e.g. an envelope, being uneven in an unchecked manner.

The above object is accomplished in accordance with the present invention by first bending the workpiece about an axis transverse to the direction of transport and then producing or forming the groove therein.

As a result of the prebending prior to the actual grooving process the paper blank is stabilized with the consequence that the desired partial cutting of the paper fibers can only occur in the immediate vicinity of the groove produced. The unchecked changes in length are thus eliminated.

The prebending of the paper blank or workpiece occurs directly on the roller-shaped opposing tool of the grooving disc which is arranged for this purpose spaced behind the tangential loading point of the workpiece in the direction of transport thereof on the opposing tool.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
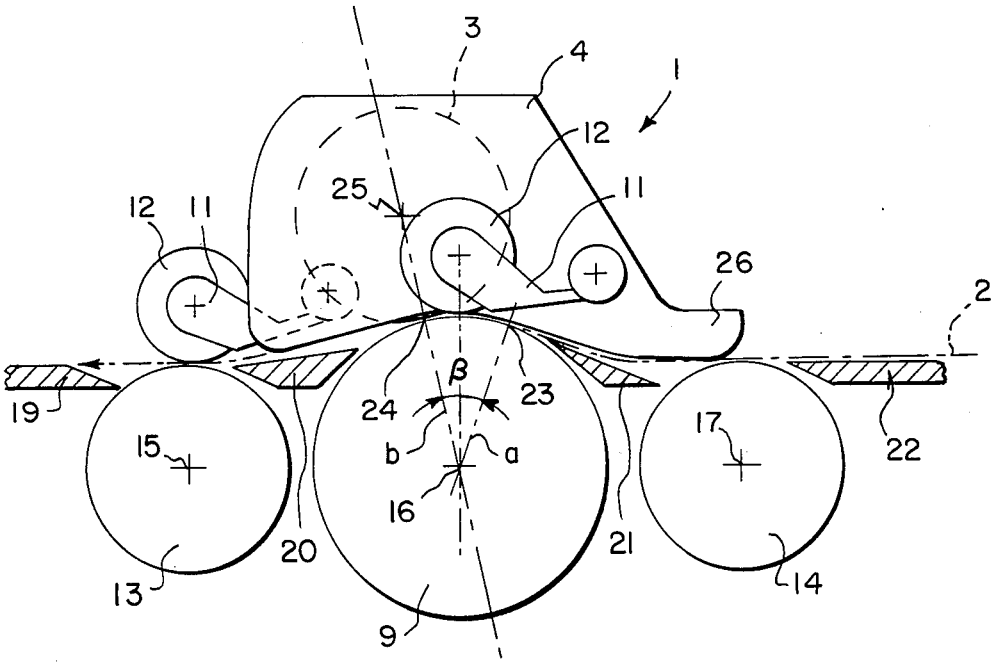
FIG. 1 is a schematic side elevational view of an apparatus in accordance with the present invention.

As can be seen in FIG. 1, there is shown an apparatus 1 for grooving or producing longitudinal grooves, i.e. partial cuts or grooves, extending in the direction of transport or parallel thereto in paper webs 2, shaped paper blanks, cardboard boxes and like workpieces. Apparatus 1 includes at least one rotatably mounted grooving disc 3 which is mounted in a carrier 4 in a suitable manner. For this purpose, as clearly seen in FIG. 2, ball bearings 5 can be disposed in a bore 6 of carrier 4 and carry a shaft 7 which carries grooving disc 3 in overhung position.

Figure 2:
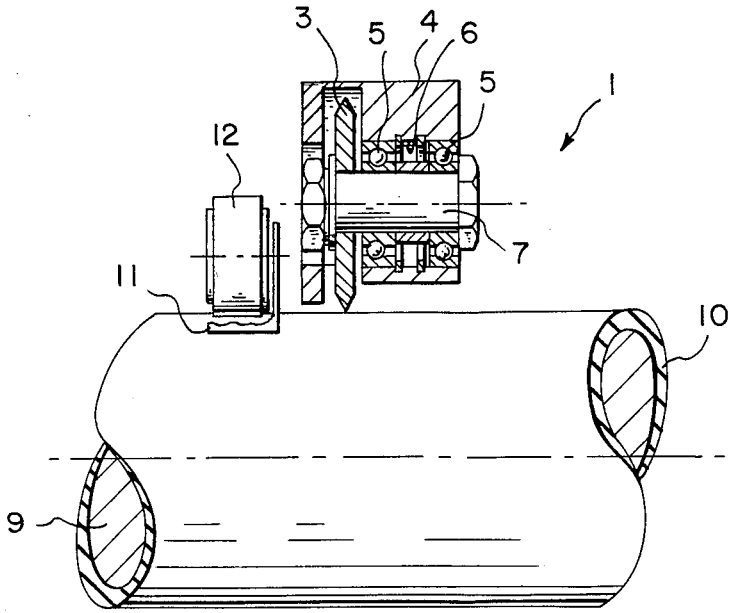
FIG. 2 is a view, partly in section, of details of the apparatus of FIG. 1 as seen in the direction of movement.
Figures 3, 4, 5, 6, 7:
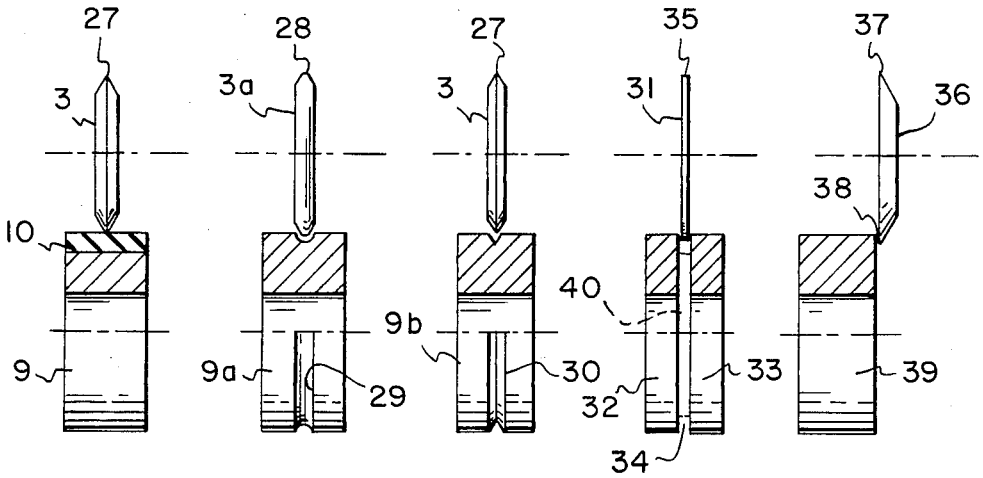
FIG. 3–FIG. 7 show different grooving discs with associated opposing tools.

A roller-shaped opposing tool 9 is also associated with grooving disc 3, which tool has a cylindrical, elastic support 10 in the embodiment illustrated in FIGS. 2 and 3.

Carrying arms 11 are further pivotably mounted on carrier 4 or on other parts of the apparatus which are not illustrated in the figures and serve as carriers for guide rolls 12 which are situated on the same side of paper web 2 as grooving disc 3. On the other side of the paper web 2, i.e. on the side of roller-shaped opposing tool 9, there are also two transport and guide rolls 13 and 14 which are disposed respectively in front of and behind roller-shaped opposing tool 9 in the direction of transport.

In the embodiment illustrated in FIG. 1, the axes of rotation 15, 16 and 17 of roller-shaped opposing tool 9 and transport and guide rollers 13 and 14 lie in a plane. This is, however, not absolutely necessary.

Finally, guide and stabilizing bodies 19 to 22 in the form of guide plates are disposed in front and behind transport and guide rolls 13 and 14 and between these and roller-shaped opposing tool 9 and optionally support paper web 2 or paper blanks 2.

Paper web or blanks 2 come against roller-shaped opposing tool 9 tangentially at a point 23 or line and lies against it in a curved configuration. The point of action 24 of grooving disc 3 is disposed in the direction of transport and offset from point 23 by an angle $\beta$. The radial connecting line "a" from the axis of rotation 16 of roller 9 to the loading point 23 and the connecting line "b" from the axis of rotation 16 to the axis of rotation 25 of grooving disc 3 thus define the angle $\beta$.

Since the paper web or blank 2 initially adopts a curved configuration following its tangential loading onto opposing roller 9, the workpiece receives a certain degree of inherent stability. Its position is defined and thus forces acting from the exterior do not lead to unchecked random changes in its structure.

Behind the point of action 24 at which grooving disc 3 and opposing roller 9 cooperate, paper web or blank 2 is conveniently guided away again from opposing roller 9 in the tangential direction. The unloading point can however also be disposed even later in the peripheral direction of opposing roller 9. It is only important that workpiece 2 is first bent about an axis transverse to the transport direction before the grooving process so that a self-stabilizing effect is achieved.

The angle $\beta$ is preferably on the order of 32°.

Carrier 4 for grooving disc 3 is finally provided also with a guide portion 26 which in the illustrated exemplary embodiment of FIG. 1 ensures the tangential transition of paper web 2 from transport and guide roll 14 to roller-shaped opposing tool 9.

FIGS. 3–7 show different grooving discs and associated roller-shaped opposing tools.

Grooving disc 3 of FIG. 3 has a V-shaped contour in the region of its working periphery 27 and opposing tool 9 is cylindrical with an elastic support 10, as already mentioned above.

Grooving disc 3*a* of FIG. 4 has a U-shaped contour in cross section in the region of its working periphery 28. Opposing tool 9*a* is provided with an annular groove 29 which is approximately semicircular in cross section.

Grooving disc 3 of FIG. 5 is again provided with a V-shaped contour in cross section of its working periphery 27. Working tool 9*b* does not however have a cylindrically flat periphery as in the exemplary embodiment illustrated in FIG. 3, but also has an annular groove 30 of V-shape in cross section.

FIG. 6 shows an exemplary embodiment in which a thin disc 31 cooperates with two opposing rollers 32 and 33 disposed adjacent and at a small distance from one another. Between opposing rollers 32 and 33 there is thus a small gap 34. The edge 35 of the grooving disc 31 thus engages in gap 34 and produces a partial cut extending in the transport direction of the workpiece.

FIG. 7 shows a grooving disc 36 whose sharp edged periphery 37 cooperates wtih an end-face edge 38 on the periphery of opposing roller 39. The periphery 37 of grooving disc 36 overlaps the edge 38 of the opposing roller 39 somewhat and thereby produces a partial cut in the workpiece.

The grooving disc 36 is conveniently frustoconical in cross section or it is at least frustoconical in the region of its periphery 37, as may be seen in FIG. 7.

It will of course be apparent that many modifications are possible without deviating from the basic inventive concept. Thus e.g. the gap 34 can be produced if the two opposing rollers 32 and 33 are roller portions which are connected by an intermediate portion 40 of smaller diameter, as is shown in phantom lines in FIG. 6.

What is claimed is:

1. In an apparatus for grooving or producing partial cuts extending parallel to the direction of transport in thin paper blanks, particularly envelope blanks, having at least one grooving disc rotatably mounted in a machine frame and an associated opposing tool in the shape of a roller, the axes of said disc and roller being arranged transverse to the direction of transport and the roller surface of said opposing tool interrupting the direction of transport of said blanks, the improvement comprising:

means for guiding and feeding said blanks along a first straight path to said opposing tool;

means for discharging said blanks from said opposing tool along a second straight path coplanar with said first straight path; and the grooving disc being spatially arranged behind the tangential loading point of the blanks on said opposing tool in the direction of transport thereof, said tangential loading point being the point at which said blanks contact the surface of the opposing tool, said grooving disc and said opposing tool having axes lying in a plane disposed obliquely with respect to the planes of said first and second paths, so that said blanks are bent around the opposing tool when contacting said grooving disc but are guided along said straight paths prior to and following contact with said opposing tool.

2. The apparatus as claimed in claim 1, wherein the angle defined between the line connecting the axis of the roller-shaped opposing tool and the loading point of the blanks and the line connecting the axes of the grooving disc and the opposing tool is greater than zero degrees.

3. The apparatus as claimed in claim 2, wherein said defined angle is approximately 32°.

* * * * *